US005718215A

United States Patent [19]

Kenny et al.

[11] Patent Number: 5,718,215

[45] Date of Patent: Feb. 17, 1998

[54] ADJUSTABLE BOW SIGHT

[75] Inventors: Paul J. Kenny, Shepherd; Richard F. Nelson, Mt. Pleasant, both of Mich.

[73] Assignee: EBSA Corporation, Shepherd, Mich.

[21] Appl. No.: 775,346

[22] Filed: Jan. 3, 1997

[51] Int. Cl.[6] ..... F41G 1/467

[52] U.S. Cl. ..... 124/87; 33/265

[58] Field of Search ..... 124/87; 33/265

[56] References Cited

U.S. PATENT DOCUMENTS

| | | | |
|---|---|---|---|
| 2,542,501 | 2/1951 | Fredrickson . | |
| 2,545,454 | 3/1951 | Fredrickson . | |
| 2,959,860 | 11/1960 | Kowalcyk . | |
| 3,058,221 | 10/1962 | McNeel . | |
| 3,063,151 | 11/1962 | Hanson . | |
| 4,215,484 | 8/1980 | Lauffenburger | 33/265 |
| 4,535,747 | 8/1985 | Kudlacek | 124/87 |
| 4,584,777 | 4/1986 | Saunders | 33/265 |
| 4,910,874 | 3/1990 | Busch | 33/265 |
| 4,977,678 | 12/1990 | Sears | 33/265 |
| 5,367,780 | 11/1994 | Savage | 33/265 |
| 5,579,752 | 12/1996 | Nelson et al. | 124/87 |

*Primary Examiner*—John A. Ricci
*Attorney, Agent, or Firm*—Howard & Howard

[57] ABSTRACT

An adjustable bow sight assembly (10) includes a mounting plate (16) extending between first and second ends (18,20). End caps (24,26) include longitudinal channels (28) for receiving the ends (18,20) in sliding engagement therein. Each of the end caps (24,26) also include a transverse aperture (44) therethrough to receive a sight bar (40,42) slidably therein. An adjustment mechanism (70) including a rack gear (80) on the end cap (24) and a spur gear (82) mounted to the plate (16) allow for selective adjustment of the end cap (24) in a vertical direction while maintaining the sight bar (40) in a fixed horizontal direction. A lever (72) is fixed to the spur gear (82) and pivotally connected to the plate (16) for rotating the gear (82) and translating the end cap (24) in the vertical direction.

17 Claims, 2 Drawing Sheets

ADJUSTABLE BOW SIGHT

TECHNICAL FIELD

The subject invention relates to a target sight apparatus which is adapted to be connected to an archery bow or other shooting device to allow adjustment of the sight along two directions.

BACKGROUND OF THE INVENTION

Target sight assemblies are commonly known in the art to aid the user of an archery bow in aiming at a predetermined target. These archery sights often include adjustment capabilities of the sight along two directions, i.e., horizontally and vertically. The adjustability compensates for variations in the way each archery bow is utilized. For example, each archer will pull back, aim and release the bow to fire the arrow differently which may cause the arrow to naturally be offset from center and misaligned with the intended target. Adjustable sight assemblies may be utilized to adjust for this offset and correct any misalignment of the bow and arrow by the user with the target.

Various target sights are known which utilize both forward and rearward adjustable sight pins which are to be aligned with the intended or desired target. Exemplary of such sights are U.S. Pat. No. 4,981,823 and U.S. Pat. No. 4,993,158, both to Santiago. The patents disclose a front and rear adjustable sight system typically used on a hand gun or rifle which includes aligning a front sight bar between the rear sight assembly including spaced apart sight pins.

Further examples include U.S. Pat. No. 5,305,728 to Young et al. and U.S. Pat. No. 5,579,752 to Nelson et al., which is also assigned to the present assignee. The patents disclose an adjustable bow sight connected to an archery bow for adjusting both a front and rear sight pin in each of the horizontal and vertical directions. In addition, the '752 patent includes a mounting plate having front and rear end caps slidably received on opposing ends of the mounting plate for allowing adjustment in the vertical direction. A front and rear sight bar are slidably connected to the respective front and rear end caps for allowing adjustment in the horizontal direction.

SUMMARY OF THE INVENTION

A bow sight assembly adapted to be secured to an archery bow comprises a mounting plate extending between a first end and a second end. First and second end caps are slidably engaged over the first end and said second ends, respectively. The first and second end caps each include a channel formed therein for receiving the first and second ends and allowing sliding of the first and second end caps in a first direction with respect to the mounting plate. First and second sight bars are slidably connected to the first and second end caps, respectively, to allow sliding of the first and second sight bars in a second direction different from the first direction with respect to the first and second end caps. Also included is an adjustment mechanism interconnected between the mounting plate and one of the first and second end caps for selectively sliding one of the first and second end caps along the first direction while maintaining the respective first and second sight bars in the second direction.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
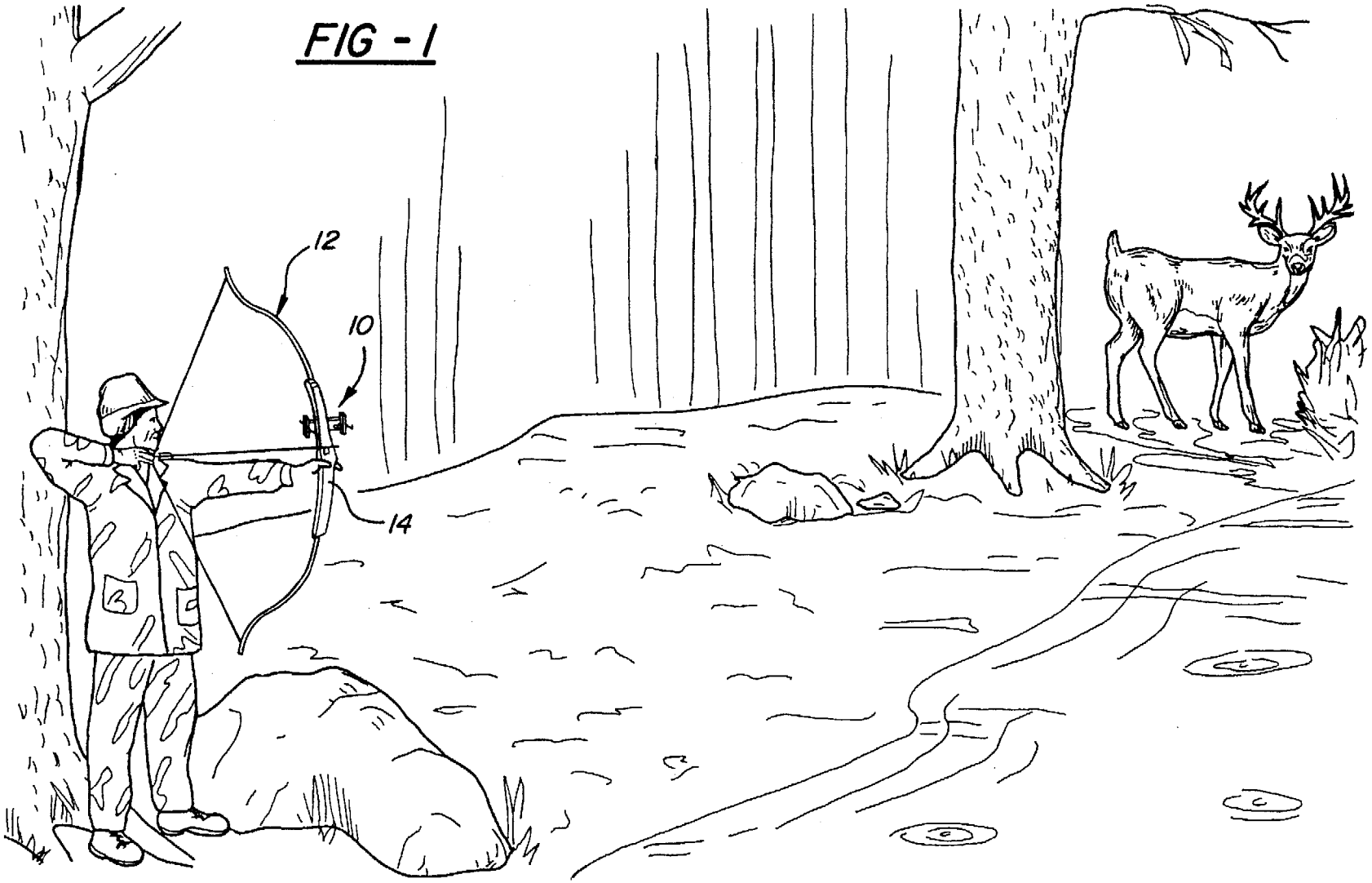
FIG. 1 illustrates the use of the subject invention.
Figure 2:
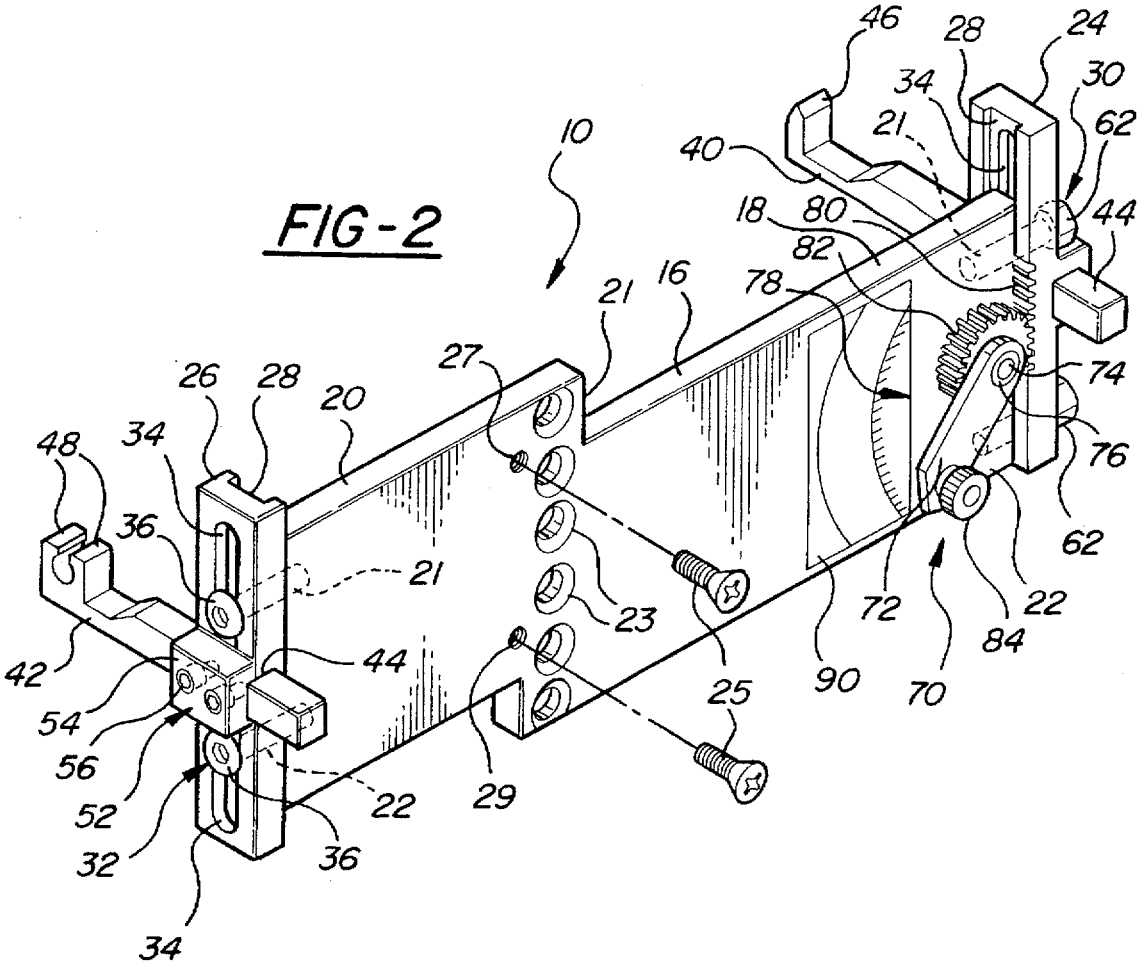
FIG. 2 is a perspective view of the subject invention.
Figure 3:
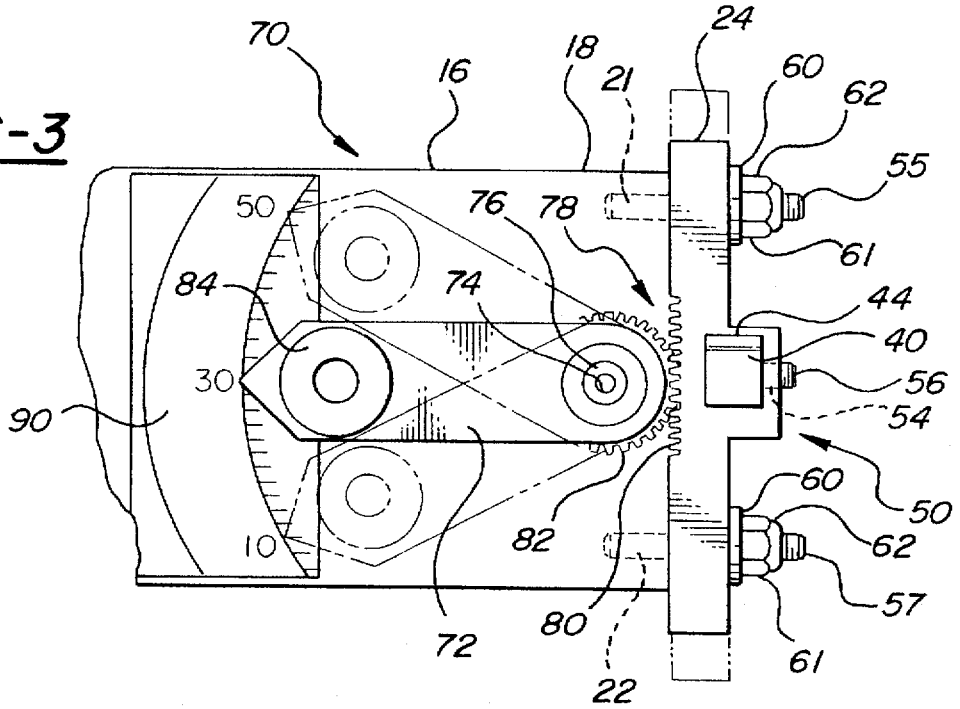
FIG. 3 is a partially broken side view of the adjustment mechanism of the subject invention.

A sight assembly 10 is illustrated in the Figures. The sight assembly 10 is adapted to be secured to an archery bow 12 in its preferred embodiment as illustrated in FIG. 1. The sight assembly 10 is fixedly connected by known means to the bow riser 14 of a typical compound or recurve type bow.

The assembly 10 includes a mounting plate 16 extending between a first end 18 and a second end 20. The mounting plate 16 generally comprises an elongated rectangular plate which extends longitudinally between the first and second ends 18, 20. The mounting plate is offset at 21 between the first and second ends 18,20 for proper alignment and mounting to the bow riser. The center portion of the mounting plate 16 includes a plurality of spaced apart recessed or countersunk apertures 23 for receiving a pair of fasteners 25 to connect the assembly 10 to the bow riser 14, or other shooting device. The offset 21 and apertures 23 allow for adjustment and varying placement when mounting the plate 16 to the riser 14. It is desirable to place the mounting plate 16 against the bow riser 14 with the first and second ends 18, 20 separated by the bow riser 14. The mounting plate 16 has a height and width greater than its thickness. Further an additional pair of spaced apart threaded apertures 27,29 extend through the mounting plate 16 for receiving and attaching an arrow quiver or other accessory on the bow 10.

The first and second ends 18, 20 both include a pair of threaded apertures 21, 22 extending longitudinally into the ends 18, 20 and spaced apart from one another at each end 18, 20.

The assembly 10 also includes first and second end caps 26 slidably engaged over the first end 18 and second end 20, respectively. The first and second end caps 24, 26 each include a longitudinal channel 28 formed therein for receiving the first and second ends 18, 20 of the mounting plate 16 allowing sliding in a first direction of the first and second end caps 24, 26 with respect to the mounting plate 16. Each of the end caps 24, 26 are rectangular in shape having a longitudinal length extending a greater length than the width of the mounting plate 16. The channels 28 extend longitudinally along the length of the end caps 24, 26 and are recessed within the end caps 24, 26 to a depth of approximately half the width of the end caps 24, 26. The channel 28 is generally a U-shaped channel for receiving and allowing flat abutment of the first and second ends 18, 20 of the mounting plate 16 securely thereagainst.

The assembly 10 includes first and second securing means 30, 32 operatively connected between the mounting plate 16 and the first and second end caps 24, 26, respectively, for securing the first and second end caps 24, 26 in one of a plurality of positions along the first direction. Each of the securing means 30, 32 include at least one elongated end opening 34 extending therethrough and opposing the channel 28. The first securing means 30 includes a pair of threaded screws 55,57 extending through the end opening 34 and threadably engaged in the threaded aperture 21, 22 of the mounting plate 16. Each of the threaded screws 55,57 receives a flat washer 60 against the end cap a spring washer 61 against the flat washer 60 and then a threaded locking nut 62, as commonly known in the art, which allows the mounting plate 16 to be clamped against the end caps 24, 26 in one of the plurality of positions along the first direction, and yet loose enough to allow sliding movement of the end caps 24, 26 relative to the mounting plate 16. In other words, the first securing means 30 retains the end cap 24 on the first end 18 while still allowing the end cap 24 to slide along the first direction by means of an adjustment mechanism 70 which will be described in further detail hereinbelow. The second securing means 32 includes a pair of cap fasteners 36 extending through the end opening 34 and threadedly engaged in the threaded apertures 21,22 in the second end 20 of the mounting plate 16. The cap fasteners 36 also allow the mounting plate 16 to be clamped against the end cap 26 in one of the plurality of positions along the first direction, and loosened to allow sliding movement of the end cap 26 relative to the mounting plate 16. The cap fasteners 36 may be commonly available hex-threaded fasteners which may be easily rotated by the user to either loosen or clamp the mounting plate 16 against the end cap 24. In the preferred embodiment, there are two end openings 34 longitudinally spaced, end-to-end, from one another in each of the end caps 24,26. Accordingly, the end cap 26 includes a cap fastener 36 and the end cap 24 includes a locking nut 62, respectively, utilized in each of the end openings 34.

The assembly 10 also includes first and second sight bars 40, 42 slidably connected to the first and second end caps 26, respectively, to allow sliding in a second direction, different from the first direction, of the first and second sight bars 40, 42 with respect to the first and second end caps 24, 26. The end caps 24, 26 each include a transverse aperture 44 therethrough in the portion without the channel 28 for receiving the sight bars 40, 42 slidably therethrough. These sight bars 40, 42 generally comprise an elongated rectangular bar or shaft which extends through the aperture 44 for adjustment in the second direction. The sight bars 40, 42 include sight pins 48 extending therefrom, respectively, to allow the user to aim at a target. Such sight pins 46, 48 are commonly known in the art. It is to be understood that such sight pins 46, 48 may comprise any type of sighting element, including a tritium sight for increased low light visibility, as is commonly known in the art. The rear sight pin 48 forms a notched peep sight opening for aligning the front sight pin 46 either between the top edges forming the notch or centered in the cylindrical opening.

The assembly 10 also includes fastening means 50,52 operatively connected between the first and second end caps 24, 26 and the first and second sight bars 40, 42, respectively, for securing the first and second sight bars 40, 42 in one of a plurality of positions along the second direction. More specifically, each of the fastening means 50, 52 includes a pair of spaced apart end apertures 54 extending through the first and second end caps 24, 26 parallel with the end openings 34 and transverse to and intersecting the transverse apertures 44. The fastening means 50, 52 also each include a pair of spaced apart bar fasteners 56 extending through the respective end apertures 54 to engage and clamp the sight bars 40, 42 against the end caps 24, 26 in one of the plurality of positions along the second direction. The bar fasteners 56 may be of a similar type utilized in the cap fasteners 36; however, the bar fasteners 56 merely abut against the sight bars 40, 42 to clamp the sight bars 40, 42 against the aperture 44 and end caps 24, 26 to prevent sliding relative thereto. The bar fasteners 56 are loosened to allow relative sliding to a desired position in the second direction.

The assembly 10 further comprises an adjustment mechanism 70 interconnected between the mounting plate 16 and the first end cap 24 for selectively sliding the first end cap 24 along the first direction with respect to the mounting plate 16 while maintaining the first sight bar 40 in the second direction. As can be appreciated, the adjustment mechanism 70 may also be interconnected between the mounting plate 16 and the second end cap 26. The adjustment mechanism 70 includes an elongated rectangular lever 72 pivotally connected to the mounting plate by a set screw 74 passing through a bearing 76 which is press fit into the distal end of the lever 72.

A gear mechanism 78 is coupled between the lever 72 and the first end cap 24 for translating the pivotal movement of the lever 72 to the linear sliding movement of the first end cap 24 along the first direction. The gear mechanism 78 includes a rack gear 80, defined by a plurality of gear teeth on the first end cap 24 adjacent the channel 28, and a spur gear 82 fixedly secured to the lever 72 between the bearing 76 and the mounting plate 16 to rotate therewith. The spur gear 82 also includes a plurality of gear teeth which are engaged with the gear teeth of the rack gear 80.

The end of the lever 72 opposite the pivot includes a locking mechanism 84 for engaging the mounting plate 16 and locking the first end cap 24 in any of a plurality of selected positions along the first direction. More specifically, the locking mechanism 84 comprises a fastener threadedly received through the lever 72 which may be tightened through the lever 72 to engage the mounting plate 16 and lock the first end cap 24 in one of the selected and adjusted positions along the first direction. The fastener may include a rubber pad to engage and compress the locking mechanism 84 against the mounting plate 16.

In operation, the assembly 10 is mounted to an archery bow or other target shooting device through the mounting plate 16 and fasteners 25. The locking mechanism 84 should be released and the lever 72 pivoted downwardly to its lowest position which in turn raises the first end cap 24 vertically with respect to the first end 18 to its highest position. The sight bars 40,42 are visually aligned with one another by sliding the bars 40,42 back and forth in the second, or horizontal, direction until aligned with a target and then tightened by fasteners 56. The second end cap 26 may then be positioned up or down in the first, or vertical, direction to align the proper elevation of the sight bars 40,42 with the intended target and then tightened by fasteners 36. A user may then shoot an arrow from the archery bow 12 at a close range target and monitor whether the arrow hit the target or was offset therefrom. If the target was hit, the assembly 10 is properly adjusted. If the arrow did not hit the target, the assembly 10 must be adjusted to compensate for such offset. For example, if the arrow went to the right, the user would adjust the sight bars 40, 42 by sliding them in the second or horizontal direction, i.e., right. If the arrow went high, the end caps 24, 26 may be slid and moved in the first or vertical direction, i.e., upwardly. During adjustment, the fastener 36, 56 may be loosened to allow sliding of the associated members, and then tightly fastened thereto to prevent further sliding movement. Such adjustments are made until the user hits the target with an arrow.

Once the assembly 10 is sighted in at a close range target, the lever 72 may be pivoted in the clockwise direction, or upward, to lower the first end cap 24 to a selected position. Lowering the first end cap 24, and thus lowering the first or front sight bar 40, prepares the assembly for alignment with a target set at a greater distance from the archer. The locking mechanism 84 may be tightened at various selected positions to retain the end cap 24 in a new position along the first, or vertical, direction.

Finally, the various selected positions for different target distances may be marked or indicated for future and repeated reference on a label 90 which is adhered to the mounting plate 16 adjacent the pointed distal end of the lever 72.

Thus, the adjustment mechanism 70 provides quick, easy and accurate adjustment of the first end cap 24 and sight bar 40 in the vertical direction for varying target distances while maintaining the alignment of the sight bars 40,42 along the horizontal direction.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

What is claimed is:

1. A bow sight assembly adapted to be secured to an archery bow, said assembly comprising:

a mounting plate extending between a first end and a second end;

first and second end caps slidably engaged over said first end and said second end, respectively, said first and second end caps each including a channel formed therein for receiving said first and second ends and allowing sliding of said first and second end caps in a first direction with respect to said mounting plate;

first and second sight bars slidably connected to said first and second end caps, respectively, to allow sliding of said first and second sight bars in a second direction different from said first direction with respect to said first and second end caps; and an adjustment mechanism interconnected between said mounting plate and one of said first and second end caps for selectively sliding one of said first and second end caps along said first direction while maintaining said respective first and second sight bars in said second direction.

2. An assembly as set forth in claim 1 wherein said adjustment mechanism includes a lever pivotally connected to said mounting plate and operatively coupled to one of said first and second end caps for engaging and sliding said one of said first and second end caps along said first direction.

3. An assembly as set forth in claim 2 further including a gear mechanism coupled between said lever and said one of said first and second end caps for translating said pivotal movement of said lever to said linear sliding movement of said one of said first and second end caps along said first direction.

4. An assembly as set forth in claim 3 wherein said gear mechanism includes a rack gear defined by a plurality of gear teeth on one of said first and second end caps and a spur gear fixedly secured to said lever to pivot therewith, said spur gear including a plurality of gear teeth engaged with said gear teeth of said rack gear.

5. An assembly as set forth in claim 4 wherein said lever includes a locking mechanism for engaging said mounting plate and locking said one of said first and second end caps in any of a plurality of selected positions along said first direction.

6. An assembly as set forth in claim 5 wherein said locking mechanism includes a fastener threadedly received through said lever for engaging said mounting plate and locking said one of said first and second end caps in any of said selected positions.

7. An assembly as set forth in claim 6 further including first and second securing means operatively connected between said mounting plate and said first and second end caps, respectively, for allowing sliding movement and securing of said first and second end caps in one of a plurality of positions along said first direction.

8. An assembly as set forth in claim 7 further including first and second fastening means operatively connected between said first and second end caps and said first and second sight bars, respectively, for allowing sliding movement and securing of said first and second sight bars in one of a plurality of positions along said second direction.

9. An assembly as set forth in claim 8 wherein each of said first and second sight bars include a sight pin extending therefrom for visual alignment on a target during use of said assembly.

10. An assembly as set forth in claim 9 wherein said first and second end caps include first and second transverse apertures therethrough for receiving said first and second sight bars slidably therethrough.

11. An assembly as set forth in claim 10 wherein each of said first and second securing means include an end opening extending through said first and second end caps aligned with said mounting plate and including cap fasteners extending through said end openings and threadedly engaged in said ends of said mounting plate to clamp said mounting plate against said end caps in one of said plurality of positions along said first direction.

12. An assembly as set forth in claim 11 wherein each of said first and second fastening means include an end aperture extending through said first and second end caps parallel with said end openings and transverse to and intersecting said transverse apertures, and bar fasteners extending through said end aperture to engage and clamp said sight bars against said end caps in one of said plurality of positions along said second direction.

13. An assembly as set forth in claim 12 wherein each of said securing means includes two spaced end openings having longitudinally extending openings and spaced longitudinally from one another, each of said end openings receiving a cap fastener.

14. An assembly as set forth in claim 13 wherein said mounting plate comprising an elongated rectangular member extending longitudinally between said first and second ends.

15. An assembly as set forth in claim 14 wherein said end caps include rectangular members with height and width greater than said first and second ends.

16. A sight assembly adapted to be secured to a shooting device, said assembly comprising:

a mounting plate extending between a first end and a second end;

first and second end caps slidably engaged at said first end and said second end, respectively, allowing sliding of said first and second end caps in a first direction with respect to said mounting plate;

first and second sight bars slidably connected through said first and second end caps, respectively, to allow sliding of said first and second sight bars in a second direction different from said first direction with respect to said first and second end caps; and an adjustment mechanism interconnected between said mounting plate and one of said first and second end caps for selectively sliding one of said first and second end caps along said first direction while maintaining said respective first and second sight bar in said second direction.

17. A sight assembly adapted to be secured to a shooting device, said assembly comprising:

a mounting plate extending between a first end and a second end;

first and second end caps, at least one of which is slidably engaged over said first end and said second end, respectively, said first and second end caps each including a channel formed therein for receiving said first and second ends allowing sliding of at least one of said first and second end caps in a first direction with respect to said mounting plate;

first and second sight bars, at least one of which is slidably connected to said first and second end caps, respectively, to allow sliding of one of said first and second sight bars in a second direction different from said first direction with respect to one of said first and second end caps, respectively; and an adjustment mechanism interconnected between said mounting plate and one of said first and second end caps for selectively sliding said one of said first and second end caps along said first direction while maintaining said respective first and second sight bar in said second direction.

* * * * *